US005711056A

United States Patent [19]

Taguchi et al.

[11] Patent Number: 5,711,056

[45] Date of Patent: Jan. 27, 1998

[54] BUCKLE FOR A PERSONAL ADORNMENT BAND

[75] Inventors: Hideo Taguchi; Junsuke Tashikie, both of Tanashi, Japan

[73] Assignee: Citizen Watch Co., Ltd., Tokyo, Japan

[21] Appl. No.: 578,538

[22] PCT Filed: May 19, 1995

[86] PCT No.: PCT/JP95/00963

§ 371 Date: Jan. 19, 1996

§ 102(e) Date: Jan. 19, 1996

[87] PCT Pub. No.: WO95/31912

PCT Pub. Date: Nov. 30, 1995

[30] Foreign Application Priority Data

May 20, 1994 [JP] Japan ..... 6-106903
May 18, 1995 [JP] Japan ..... 7-118837

[51] Int. Cl.[6] ..... A44C 5/00

[52] U.S. Cl. ..... 24/69 J; 24/71 J; 24/265 WS; 24/656

[58] Field of Search ..... 24/69 R, 70 J, 24/69 J, 71 J, 68 J, 265 WS, 601.5, 657, 656

[56] References Cited

U.S. PATENT DOCUMENTS 3,665,565 5/1972 Kruger ..... 24/165
4,382,318 5/1983 Takimoto ..... 24/188
4,675,955 6/1987 Nakamura ..... 24/656
4,928,359 5/1990 Gagnebin ..... 24/71 J
5,191,685 3/1993 Aoki et al. ..... 24/656
5,305,503 4/1994 Yamagata ..... 24/71 J X
5,313,691 5/1994 Hashimoto ..... 24/69 J

*Primary Examiner*—Peter M. Cuomo
*Assistant Examiner*—Stephen Vu
*Attorney, Agent, or Firm*—Dennison, Meserole, Pollack & Scheiner

[57] ABSTRACT

A pair of push plates (11, 12) are slidably mounted in a housing (3) so as to be moved in a lateral direction with respect to a longitudinal direction of a personal adornment band (2), one of the push plates (11) has an upper arm (15) having a thickness of an upper half thickness of the push plate, the other push plate (12) has a lower arm (16) having a thickness of a lower half thickness of the push plate, upper and lower arms are overlapped with each other, and a pair of return springs (13) are provided between the push plates for urging each push plate in an outward direction. A cover (4) has a lock pin (21) secured to the underside thereof to be engaged with engaging hooks (20, 20*c*) of the push plates. In a coupling state of the buckle (1), an engaging rod (23*a*) provided on a connecting link (23) of an end of the personal adornment band is held by the cover and the housing which are locked each other. When the push plates are pushed at the same time, the engaging hooks are disengaged from the lock pin of the cover, so that the cover is opened and the connecting link is disconnected from the housing.

6 Claims, 7 Drawing Sheets

BUCKLE FOR A PERSONAL ADORNMENT BAND

TECHNICAL FIELD

The present invention relates to a connecting member for connecting a personal adornment band such as a watch band and a bracelet so as to form a loop, and more particularly to a buckle as a connecting member properly applicable for a personal adornment band having a small width such as a lady's bracelet and watch band.

BACKGROUND ART

FIG. 11 shows a conventional buckle for a watch band having a pair of push plates. A buckle 40 comprises a housing 41, a pair of push plates 42 slidably mounted in a housing space 43 formed in the housing 41 so as to be moved in the lateral direction with respect to the longitudinal direction of a watch band (not shown). The push plates 42 are the same in configuration and are disposed in symmetry with respect to a point of a center of the housing space 43. Each push plate 42 comprises an engaging hook 44 having a semi-circular shape and an upward slant, and disposed opposite to each other. Between the push plates 42, a pair of return springs 45 are provided on both sides with respect to the longitudinal direction of the push plates and disposed in point symmetry so as to outwardly urge the push plates. A pair of stopper pins 46 are pressed into holes formed in the housing, so that each stopper pin 46 is engaged with a groove 42*a* formed in the corresponding push plate 42. Each of the push plates 42 is stopped by the stopper pin 46 at a position where an end of the push plate is projected from the housing 41. Thus, the push plates are prevented from removing from the housing.

On an end of the buckle 40, a cylindrical connecting member 47 is formed. A cover (not shown) is pivotally mounted on the connecting member. The cover has a lock pin 21, as shown in FIG. 1, having a hemisphere head securely mounted on the underside of the cover. The lock pin 21 engages with the engaging hooks 44 of the respective push plates.

In such a buckle, the push plates and the return springs are arranged on a plane in the housing space and in symmetry with respect to the point of the center of the housing space. Accordingly, the width of the buckle becomes large. It is difficult to use such a wide buckle for a lady's band having a small width.

Therefore, an object of the present invention is to provide a buckle which has a small width, and a small size as a whole, nevertheless has a sufficient strength.

DISCLOSURE OF THE INVENTION

According to the present invention, there is provided a buckle for a personal adornment band comprising a housing having an opening at an upper portion and connected to an end of the personal adornment band, a pair of push plates provided in the housing so as to be moved in a lateral direction with respect to a longitudinal direction of said personal adornment band, a cover pivotally connected to an end of said housing, an engaging rod provided on a connecting link of the other end of the personal adornment band and held by the housing and the cover so as to connect both ends of the personal adornment band, characterized in that each of the push plates has a manipulating projection, an arm inwardly projected from said manipulating projection, and an engaging portion formed on an end of the arm, one of said push plates has an upper arm having a thickness of an upper half thickness of the push plate, the other push plate has a lower arm having a thickness of a lower half thickness of the push plate, the upper and lower arms are disposed in a same position in plane and overlapped with each other, spring means is provided between said push plates for urging each of said push plates in an outward direction, stopping means is provided for stopping each of said push plates urged by said spring means at a position where the manipulating projection of each push plate is projected from the housing, and a lock pin is secured to an underside of the cover to be engaged with said engaging portions of the push plates.

In an aspect of the present invention, the upper and lower arms of the push plates are disposed on the deflected sides of the push plates, the stopping means comprises a stopper pin secured to the housing and disposed to be abutted on side walls of notches formed on insides of the upper and lower arms of the push plates, the engaging portion of each of said push plates has the engaging hook to be engaged with the lock pin of the cover, the engaging portion has the same thickness as the manipulating projection of the push plate, and the engaging hook is defined by the escapement groove formed on the underside thereof.

In another aspect of the invention, the upper and lower arms of the push plates are disposed on a central portions of the push plates, the stopping means comprises a stopper pin secured to the housing and disposed to be abutted on side walls of notches formed on outsides of the upper and lower arms of the push plates, the engaging portion of each of said push plates has the engaging hook to be engaged with the lock pin of the cover, the engaging portion has the same thickness as the manipulating projection of the push plate, and the engaging hook is defined by the escapement groove formed on the underside thereof, the cover comprises a pair of connecting lugs formed on opposite sides at a base portion thereof and a lateral plate integrally formed with the lugs.

In a coupling state of the buckle, an engaging rod provided on a connecting link of an end of the personal adornment band is held by the cover and the housing which are locked each other. When the push plates are pushed at the same time, the engaging hooks are disengaged from the lock pin of the cover, so that the cover is opened and the connecting link is disconnected from the housing.

BEST MODE FOR EMBODYING THE INVENTION

Figure 1:
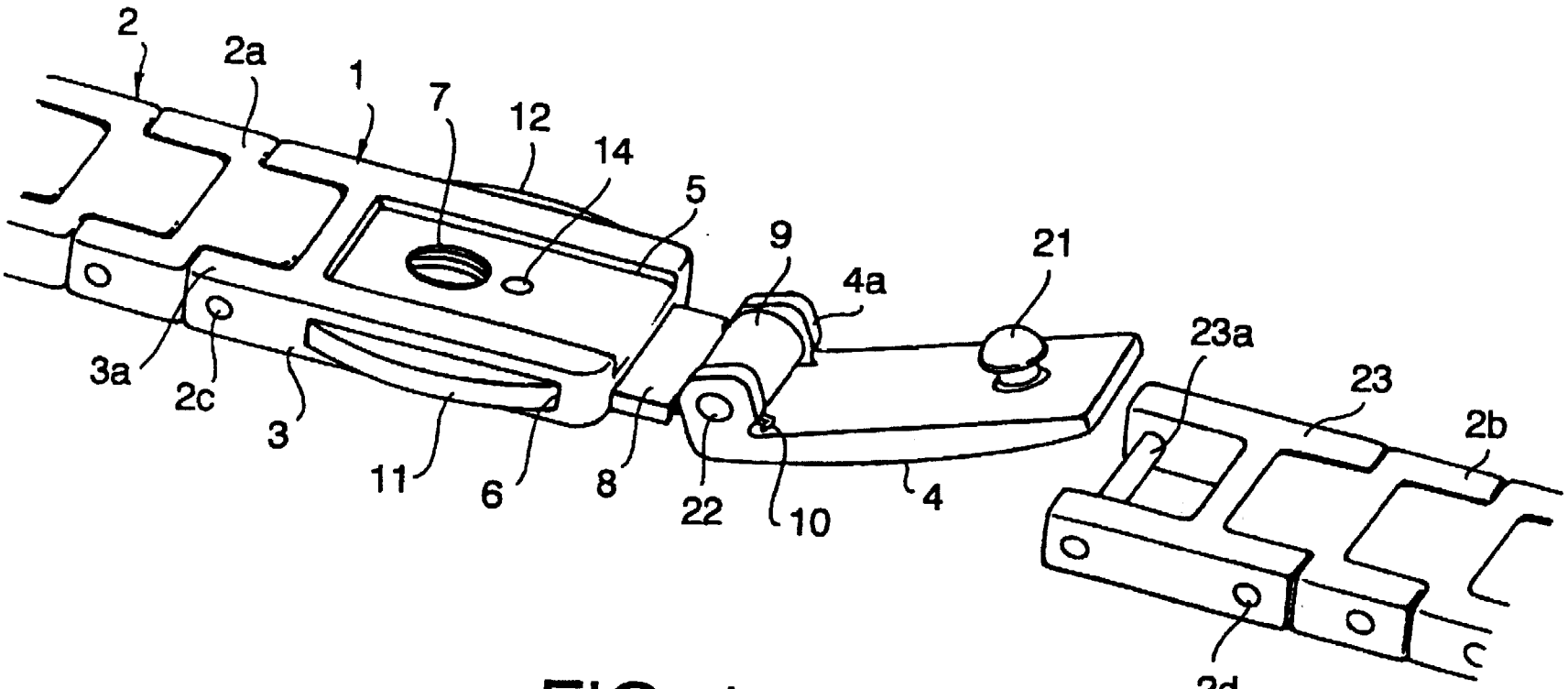
FIG. 1 is a perspective view showing a buckle for a watch band as a first embodiment according to the present invention.

Embodiments of the present invention will be described hereinafter in detail based on the accompanying drawings. FIG. 1 is a perspective view showing a buckle for a watch band as a first embodiment according to the present invention, and FIG. 2 is a sectional plan view showing a main part of the buckle.

Figure 2:
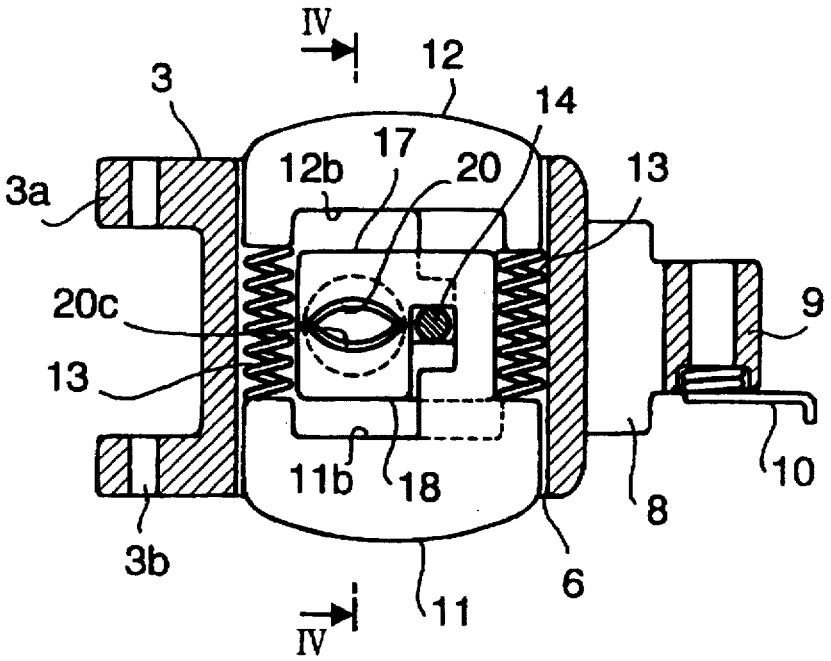
FIG. 2 is a sectional plan view showing a main part of the buckle.

Referring to FIGS. 1 and 2, a buckle 1 of the present invention comprises a housing 3 pivotally connected to a link 2*a* of an end of a watch band 2, a cover 4 pivotally mounted on an end portion of the housing 3, and a connecting link 23 connected to a link 2*b* of the other end of the watch band.

As shown in FIG. 1, the housing 3 has an upper recessed portion 5 slightly indented from the upper surface of the housing to be engaged with the cover 4. As shown in FIG. 2, a lateral housing space 6 is formed in the housing, opened at the opposite sides of the housing. The upper recessed portion 5 has an opening 7 having circular shape to be communicated with the housing space 6. A pair of connecting lugs 3*a* are projected from a base portion of the housing. Each of the connecting lugs 3*a* has a lateral hole 3*b* in which a pin 2*c* is inserted to connect with the end link 2*a* of the band. A supporting projection 8 is projected from a lower portion of the recessed portion 5 opposite to the connecting lugs 3*a* and a cylindrical connecting member 9 is formed on an end of the supporting projection 8. A coil spring 10 is engaged in a large diameter hole formed in the connecting member 9 as shown in FIG. 2. An inner end of the spring 10 is fixed to the connecting member 9 and an outer end of the spring 10 is projected from the connecting member 9.

A pair of push plates 11 and 12 are slidably mounted in the housing space 6 so as to be moved in the lateral direction with respect to the longitudinal direction of the band. The push plates 11 and 12 have axial symmetrical configuration approximately in plane with respect to the longitudinal axis of the band, and are disposed in symmetry in the housing space 6, partially overlapped.

Figure 3:
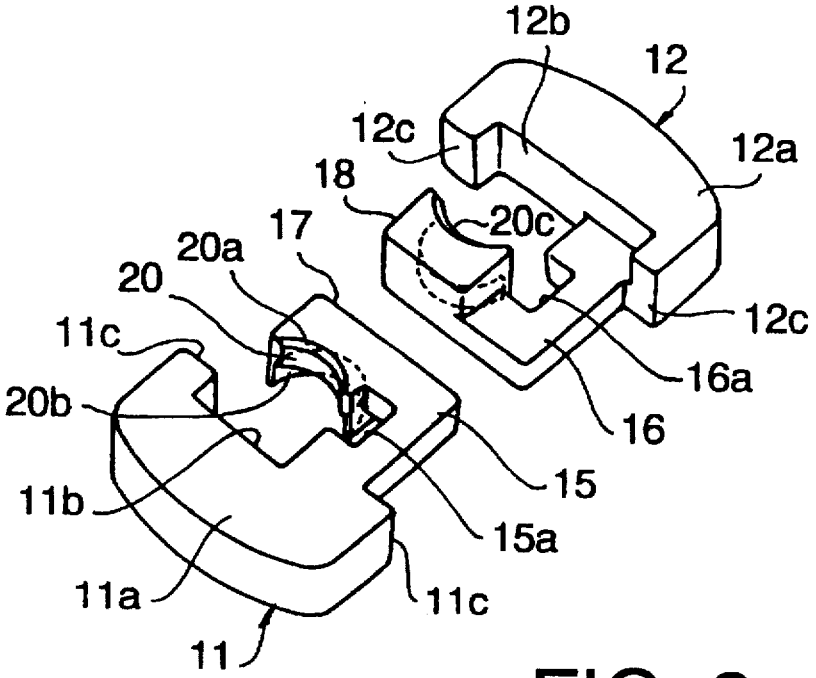
FIG. 3 is an exploded perspective view showing a pair of push plates of the buckle.

As shown in FIG. 3, the push plate 11 comprises a manipulating projection 11*a* projected from the housing space 6, a notch 11*b* formed on an inner portion of the manipulating projection 11*a*, and an upper arm 15 extending from a deflected side of the notch 11*b* in the inner direction. The upper arm 15 has a thickness of an upper half thickness of the push plate 11, and an upper surface coplanar with that of the push plate 11. An inner notch 15*a* is formed on an inside of the upper arm 15.

Figure 4:
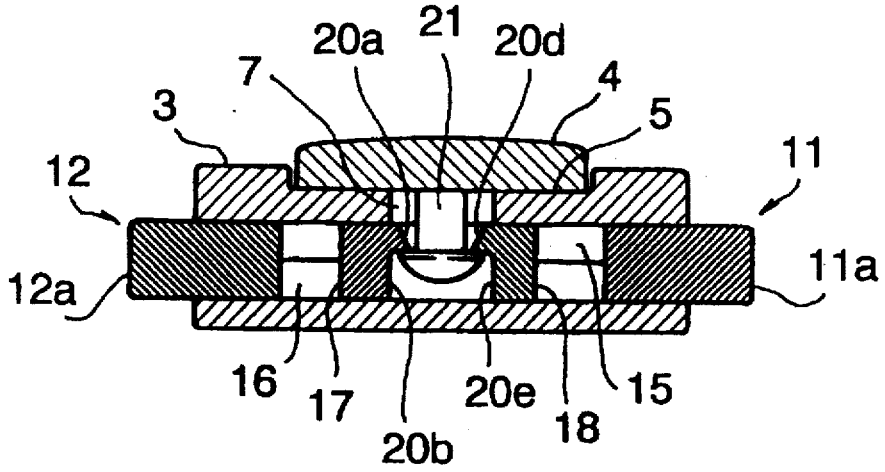
FIG. 4 is a sectional side view of the buckle taken along a line IV—IV of FIG. 2.

An engaging portion 17 is formed on an end of the upper arm 15 and faced to the notch 11*b*. Upper and lower surfaces of the engaging portion 17 are coplanar with those of the push plate 11. The engaging portion 17 comprises an engaging hook 20 having a semi-circular shape and a spherical slant 20*a* formed on the upper edge opposite to the notch 11*b*. On a lower portion of the hook 20, an escapement groove 20*b* having a shoulder portion is formed, thereby forming an edge of the hook 20 as shown in FIG. 4.

The other push plate 12 comprises a manipulating projection 12*a* projected from the housing space 6, a notch 12*b* formed on an inner portion of the manipulating projection 12*a*, and a lower arm 16 extending from a deflected side of the notch 12*b* in the inner direction. The lower arm 16 has a thickness of a lower half thickness of the push plate 12, and a lower surface flush with that of the push plate 12. An inner notch 16*a* is formed on an inside of the lower arm 16.

An engaging portion 18 is formed on an end of the lower arm 16 and faced to the notch 12*b*. Upper and lower surfaces of the engaging portion 18 are flush with those of the push plate 12. Similar to the engaging portion 17, the engaging portion 18 comprises an engaging hook 20*c* having a semi-circular shape formed on the upper edge opposite to the notch 12*b*. The engaging hook 20*c* has a spherical slant 20*d* and an escapement groove 20*e* formed on the underside thereof to form an engaging edge.

In assembling, the upper arm 15 of the push plate 11 is mounted on the lower arm 16 of the push plate 12 to be slidably overlapped each other. Namely, the engaging portion 17 is disposed over the engaging portion 18 so that the engaging hooks 20 and 20*c* are opposed to each other. The escapement grooves 20*b* and 20*e* under the hooks 20, 20*c* are opposed to each other accordingly. A pair of return springs 13 are disposed between projecting portions 11*c* and 12*c* formed on opposite sides of the respective notches 11*b* and 12*b* of the push plates 11 and 12.

The push plates 11, 12 and the springs 13 are assembled and inserted into the housing space 6 from one of the sides of the housing 3. Thereafter, a stopper pin 14 is pressed into a hole formed in the upper recessed portion 5 of the housing and inserted into a space formed between the inner notches 15*a* and 16*a* and engaging portions 17 and 18 of the upper and lower arms 15 and 16 to be abutted on the side walls thereof. Each of the push plates 11, 12 is stopped by the stopper pin 14 at a position where the manipulating projections 11*a*, 12*a* of the push plates are projected from the housing 3. The circular opening 7 of the housing 3 is positioned opposite the engaging hooks 20, 20*c* of the push plates 11, 12.

Figure 5:
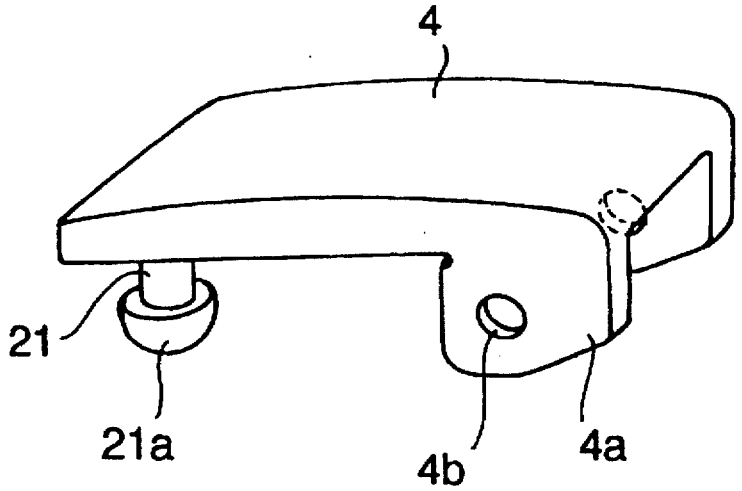
FIG. 5 is a perspective view showing a cover.
Figure 6:
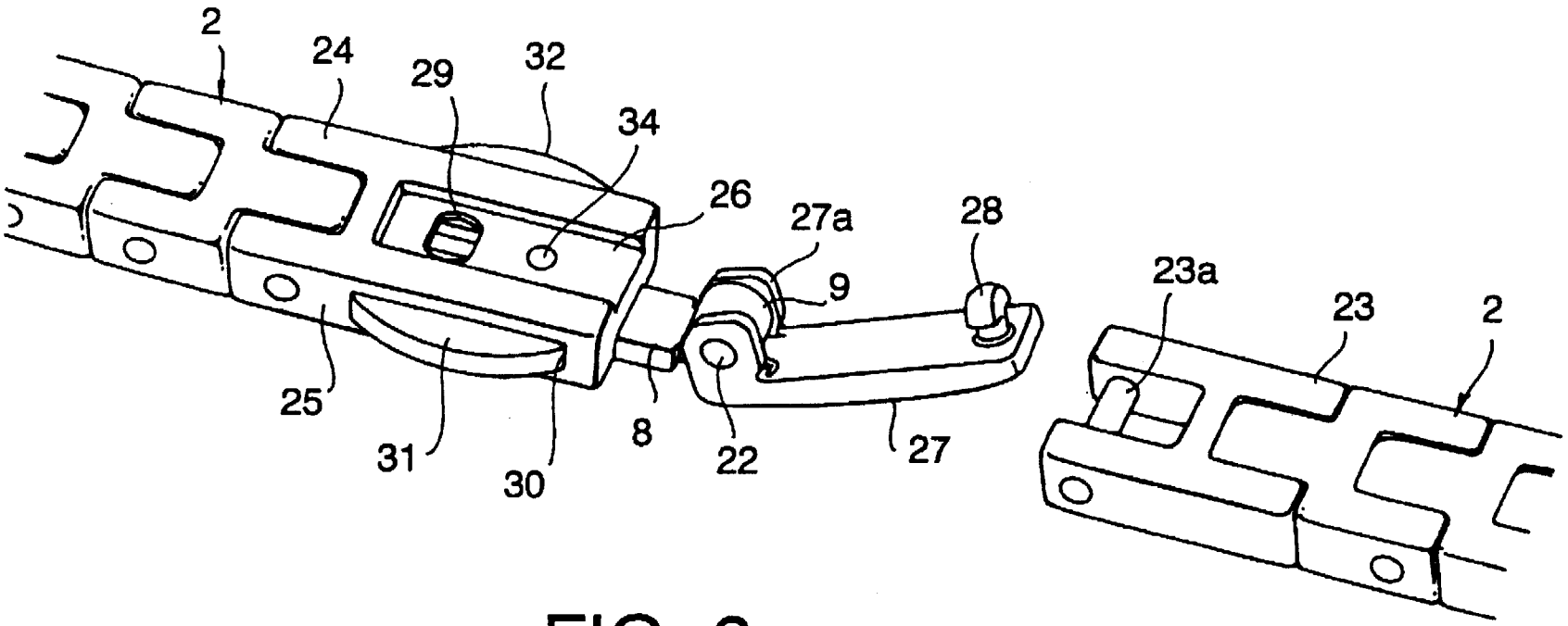
FIG. 6 is a perspective view showing a buckle of a second embodiment of the present invention.

Referring to FIG. 5, the cover 4 comprises a lock pin 21 securely mounted on the underside thereof. The lock pin 21 has a head 21*a* of a hemisphere shape corresponding to the opening 7 of the recessed portion 5. A pair of connecting lugs 4*a* having holes 4*b* are formed on opposite sides of the cover 4 at a base portion thereof.

As shown in FIG. 1, a pin 22 is inserted in holes 4*b* of the connecting lugs 4*a* and the hole of the connecting member 9 having the spring 10, so that the cover 4 is pivotally connected with the housing 3. Since the outer end of the spring 10 is abutted on the underside of the cover 4, the cover 4 is outwardly urged by the spring 10 to be opened as shown in FIG. 1.

An engaging rod 23*a* is laterally provided on an end of the connecting link 23 which is connected to the end link 2*b* of the band 2 with a pin 2*d*.

Method of coupling the buckle 1 will be described hereinafter. The cover 4 is inserted into an opening behind the engaging rod 23*a* from the underside of the connecting link 23. The engaging rod 23*a* is put on the supporting projection 8 of the housing 3, and the cover 4 is rotated about the pin 22 over the engaging rod 23*a*. The cover 4 is pushed so as to be abutted on the upper recessed portion 5 so that the lock pin 21 is inserted into the opening 7 of the recessed portion 5. The hemisphere head 21*a* of the lock pin 21 engages with the slants 20*a*, 20*d* of the engaging hooks 20, 20*c* of the respective push plates 11, 12 to outwardly push the push plates against the elastic force of the springs 13. When the hemisphere head 21*a* passes the engaging hooks, the engaging hooks are returned by the springs 13 and engaged with a stem of the lock pin 21. On the other hand, the hemisphere head 21*a* engages with the escapement grooves 20*b*, 20*e*.

Thus, both ends of the band 2 are coupled with each other through the buckle 1.

In order to disengage the buckle 1, the manipulating projections 11*a*, 12*a* of push plates 11, 12 are pushed at the same time so that the engaging hooks 20, 20*c* are opened to disengage the lock pin 21. At that time, since the notches 11*b* and 12*b* are formed in the push plates 11, 12, each of the engaging portions 17 and 18 enters the notch of the opposite push plate. Thus, the engaging portions 17 and 18 are prevented from striking the opposite push plates. Since the end of the spring 10 engages the underside of the cover 4 to urge it in the upward direction, the cover 4 is automatically opened when the lock pin 21 is released. Thereafter, the engaging rod 23*a* is removed from the supporting projection 8. Thus, the connecting link 23 is disconnected from the buckle 1.

In accordance with the present invention, the push plates are partially overlapped with each other, thereby reducing the width of the buckle. Consequently, the buckle is available for the personal adornment band having a small width.

In the first embodiment, since the width of each of the upper and lower arms 15 and 16 is small, it may happen that the strength of the arm becomes insufficient. In order to supplement the strength, if the width of the arm is increased, the width of the buckle is increased. Furthermore, the circular-shaped opening 7 of the upper recessed portion 5 is positioned close to the hole for the stopper pin 14. Therefore, it may occur that the recessed portion 5 breaks at a portion between the holes. Furthermore, due to the hemisphere head 21*a* of the lock pin 21, it is necessary to provide a sufficient space on the cover 4 for the hemisphere head with respect to the longitudinal direction of the cover. As a result, the length of the cover is increased. The long cover lenders the appearance of the buckle deteriorative.

FIGS. 6 to 9 show a second embodiment which may solve the above mentioned disadvantages. The parts which are the same as the first embodiment are identified with the same reference numerals as FIGS. 1 to 5. A buckle 24 has a housing 25 and a cover 27, similar to the previous embodiment. An upper recessed portion 26 of the housing 25 has a rectangular opening 29. In a housing space 30, a pair of push plates 31 and 32 are slidably mounted and partially overlapped with each other.

Figure 8:
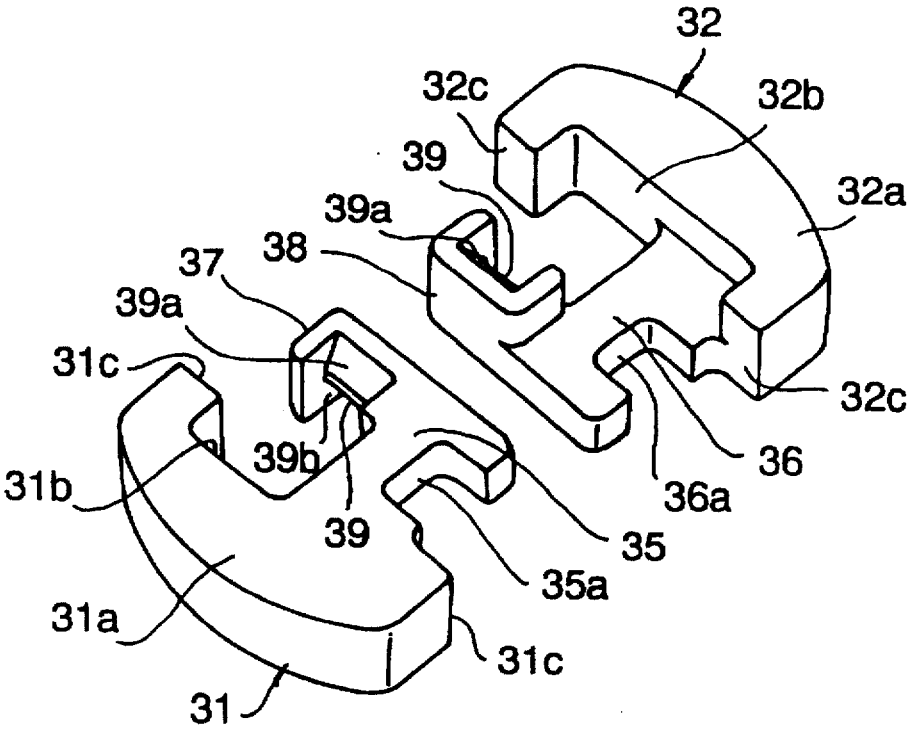
FIG. 8 is an exploded perspective view showing a pair of push plates of the buckle of the second embodiment.

Referring to FIG. 8, the push plate 31 comprises a manipulating projection 31*a* and a notch 31*b* formed on an inner portion of the manipulating projection. An upper arm 35 is inwardly extending from a central portion of the manipulating projection 31*a*. The upper arm 35 has the same thickness as an upper half thickness of the push plate 31. An upper surface of the upper arm is coplanar with that of the push plate. An outer notch 35*a* is formed on an outside of the upper arm 35, and an engaging portion 37 is formed on an inside thereof. The engaging portion 37 has a U-shape in plane, provided opposite to the notch 31*b*. The upper and lower surfaces of the engaging portion 37 are flush with those of the push plate 31. The engaging portion 37 has an engaging hook 39 having a downward slant 39*a* formed on an upper portion corresponding to the notch 31*b*. An escapement groove 39*b* is provided on a lower portion of the engaging hook 39 to form an engaging edge of the engaging hook.

The other push plate 32 is formed in axial symmetry with the push plate 31 with respect to the longitudinal axis of the band, and has a manipulating projection 32*a* and a notch 32*b*. A lower arm 36 is inwardly extending from a central portion of the manipulating projection 32*a* corresponding to the upper arm 35. The lower arm 36 has a lower surface flush with that of the push plate 32, and has the same thickness as a lower half thickness of the push plate. An outer notch 36*a* is formed on an outside of the lower arm 36, and an engaging portion 38 is formed on an inside thereof. The upper and lower surfaces are flush with those of the push plate 32. Similar to the engaging portion 37, the engaging portion 38 has an engaging hook 39 having a downward slant 39*a*, and an escapement groove 39*b* formed on the underside of the engaging hook.

Figure 7:
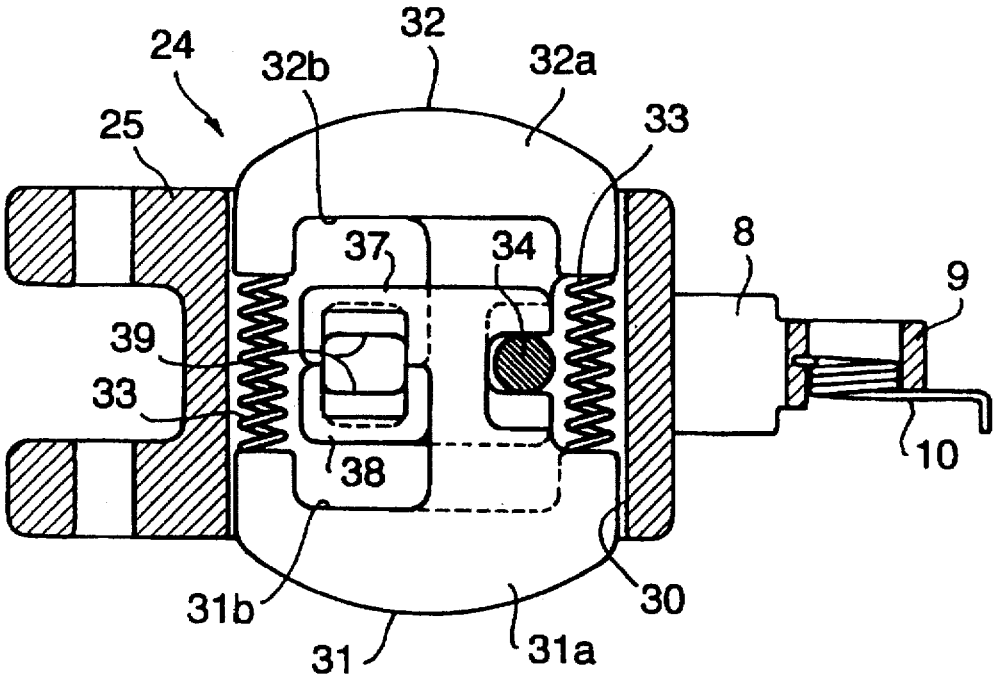
FIG. 7 is a sectional plan view showing a main part of the buckle of the second embodiment.

In assembling, the upper arm 35 of the push plate 31 is mounted on the lower arm 36 of the push plate 32 to be slidably engaged with each other. The engaging portions 37 and 38 are disposed coplanar with the upper surfaces of the push plates, while the engaging hooks 39 are faced to each other. A pair of return springs 33 are disposed between projecting portions 31*c* and 32*c* formed on opposite sides of the respective push plates 31 and 32. The assembled push plates and the springs are inserted into the housing space 30 of the housing 25. A stopper pin 34 is pressed into a hole formed in the recessed portion 26 of the housing and inserted in a space between the notches 35*a* and 36*a* of the upper and lower arm 35 and 36 (FIG. 7). Thus, each of the push plates 31, 32 is prevented from removing from the housing 25. The rectangular opening 29 of the recessed portion 26 is positioned opposite the hooks 39 of the push plates 31, 32.

Figure 9:
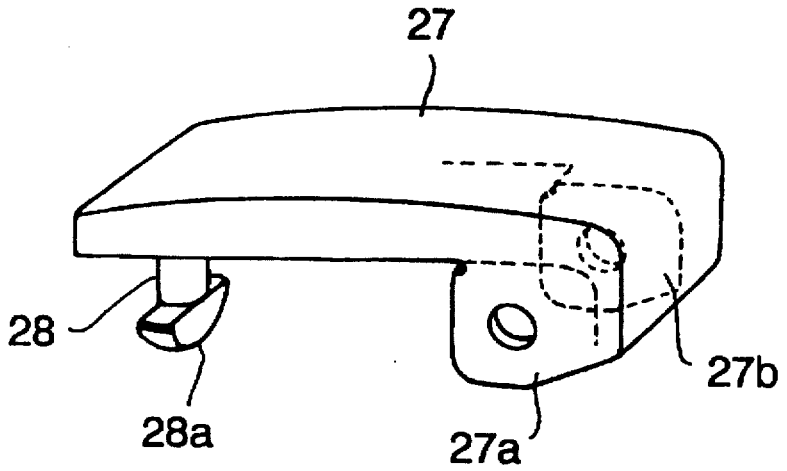
FIG. 9 is a perspective view showing a cover of the buckle of the second embodiment.
Figure 11:
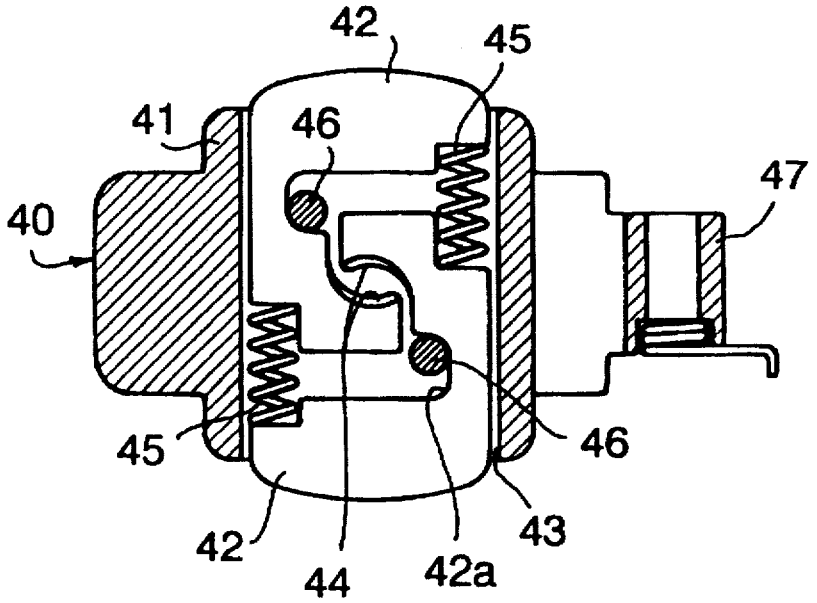
FIG. 11 is a sectional plan view of the conventional buckle.

Referring to FIG. 9, a lock pin 28 securely mounted on the underside of the cover 27 has a flat head 28*a*. The head 28*a* is formed into a flat plate having a semi-circular shape by parallelly cutting a head having a hemisphere shape at both sides. The rectangular opening 29 of the recessed portion 26 of the housing 25 is formed corresponding to the configuration of the head. The cover 27 has a pair of connecting lugs 27*a*, and a lateral plate 27*b* integrally provided between the lugs.

Engaging and disengaging methods of the buckle 24 are the same as the previous embodiment. Namely, the cover 27 is inserted into the opening of the connecting link 23 and the lock pin 28 is inserted in the rectangular opening 29 of the recessed portion 26 of the housing 25. The flat head 28*a* of the lock pin 28 engages with the slants 39*a* of the engaging hooks 39 of the respective push plates 31, 32 to outwardly push the push plates against the elastic force of the springs 33. When the head 28*a* passes the engaging hooks 39, the engaging hooks are returned by the springs 33 and engaged with a stem of the lock pin 28. The head 28*a* engages with the engaging edges of the hooks. By pushing the manipulating projections 31*a*, 32*a* of push plates 31, 32 at the same time, the engaging hooks 39 are opened to disengage the lock pin 28.

In the embodiment, the upper and lower arms of the push plates are respectively extending from the central portions of the manipulating projections of the push plates and the notches for the stopper pin are formed on the outsides of the respective arms. Thus, the widths of the upper and lower arms can be increased to increase the strength. Since the notches engaged with the stopper pin are formed on the outsides of the arms, the stopper pin is located on the recessed portion away from the rectangular opening. Consequently, the wall of the recessed portion is not broken.

Since the width of the flat head of the lock pin is reduced in the longitudinal direction, the length of the cover is reduced, thereby improving the appearance. Furthermore, the cover has the lateral plate to wall up the space between the connecting lugs. Thus, the connecting structure of the buckle and the band is hidden, thereby further improving the appearance and increasing the strength.

Figure 10:
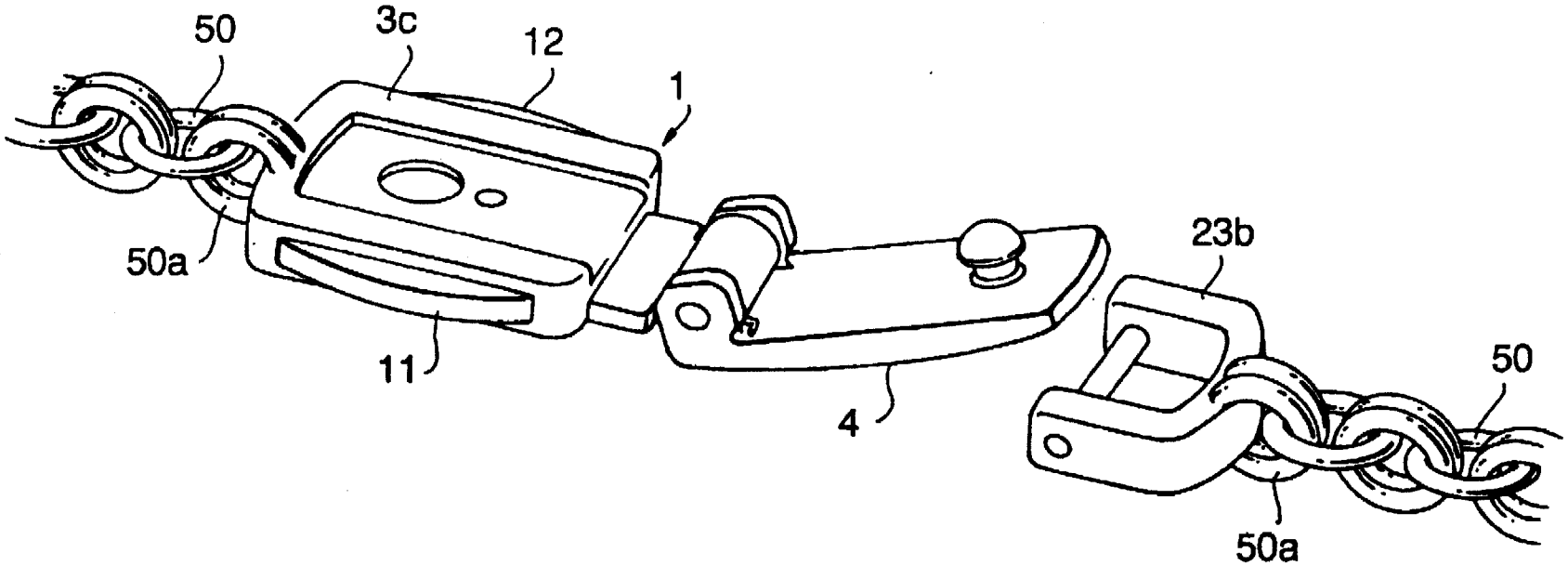
FIG. 10 is a perspective view showing a buckle of a third embodiment of the present invention.

FIG. 10 shows a perspective view of a third embodiment. The buckle 1 of the first embodiment is applied to a bracelet 50. A housing 3*c* as well as a connecting link 23*b* has a base portion having an arc shape. An end ring 50*a* having a shape of a ring of the bracelet 50 is secured to each of the base portions by brazing. Since the structure of the buckle of the embodiment is the same as the first embodiment, the description thereof is omitted.

In the third embodiment, although the end ring 50*a* is secured to the housing 3*c* by brazing, a hole may be formed on the base portion of the housing 3*c* for inserting the end ring 50*a* to be connected thereto. In order to connect bracelets having various configurations, the bracelet may be connected to the housing with a connecting member such as a spring-loaded pin.

PROBABILITY OF INDUSTRIAL EXPLOITATION

In accordance with the present invention, the push plates are partially overlapped with each other. Thus, the buckle is used to the personal adornment band having a small width. By selecting the configuration of the push plate and varying the configuration of the head of the lock pin, the size of the buckle is reduced, the appearance and quality are improved, and the strength is increased.

We claim:

1. A buckle for a personal adornment band comprising:

a housing having an opening at an upper portion, said housing connected to an end of the personal adornment band, a pair of push plates arranged in the housing so as to be moved in a lateral direction with respect to a longitudinal direction of said personal adornment band, a cover pivotally connected to a first end of said housing, an engaging rod provided on a connecting link of a second end of the personal adornment band and held by the housing and the cover so as to connect the first and second ends of the personal adornment band, each of the push plates including a manipulating projection, an arm inwardly projected from said manipulating projection, and an engaging portion formed on an end of the arm;

each of the engaging portions of said push plates having an engaging hook to be engaged with the lock pin of the cover;

each engaging portion having the same thickness as the manipulating projection of the push plate, the engaging hook being defined by an escapement groove formed on the underside thereof;

one of said push plates having an upper arm with a thickness of an upper half thickness of the push plate;

the other push plate having a lower arm with a thickness of a lower half thickness of the push plate;

the upper and lower arms being overlapped with each other and positioned with respect to the longitudinal direction of said band in a plane including an upper surface of the upper arm;

spring means provided between said push plates for urging each of said push plates in an outward direction;

stopping means provided for stopping each of said push plates urged by said spring means at a position where the manipulating projection of each push plate is projected from the housing;

a lock pin secured to an underside of the cover to be engaged with said engaging portions of the push plates; and said stopping means comprises a stopper pin secured to the housing and disposed to be abutted on side walls of notches formed on side portions of the upper and lower arms of the push plates.

2. The buckle according to claim 1 wherein the upper and lower arms of the push plates are disposed on the deflected sides of the push plates, the stopping means comprises a stopper pin secured to the housing and disposed to be abutted on side walls of notches formed on insides of the upper and lower arms of the push plates, the engaging portion of each of said push plates having the engaging hook to be engaged with the lock pin of the cover, the engaging portion having the same thickness as the manipulating projection of the push plate, said engaging hook being defined by an escapement groove formed on the underside of the engaging portion.

3. The buckle according to claim 1 wherein the upper and lower arms of the push plates are disposed on central portions of the push plates, the stopping means having a stopper pin secured to the housing and disposed to be abutted on side walls of notches formed on outsides of the upper and lower arms of the push plates, the engaging portion of each of said push plates having the engaging hook to be engaged with the lock pin of the cover, the engaging portion having the same thickness as the manipulating projection of the push plate, and the engaging hook being defined by the escapement groove formed on the underside of the engaging portion, the cover comprising a pair of connecting lugs formed on opposite sides at a base portion of the cover and a lateral plate integrally formed with the connecting lugs.

4. A buckle for attachment to each end of a personal adornment band comprising a housing having an opening at an upper portion and a first housing end connected to a first end of the personal adornment band, a pair of push plates provided in the housing so as to be moved in a lateral direction with respect to a longitudinal direction of said personal adornment band, a cover pivotally connected to a second end of said housing, an engaging rod provided on a connecting link of a second end of the personal adornment band and held by the housing and the cover so as to connect both ends of the personal adornment band, each of the push plates having a manipulating projection, an arm inwardly projected from said manipulating projection, and an engaging portion formed on an end of the arm;

each engaging portion of the push plates including an engaging hook to be engaged with the lock pin of the cover;

each engaging portion having the same thickness as the manipulating projection of the push plate, and the engaging hook being defined by an escapement groove formed on the underside thereof;

one of said push plate arms being an upper arm having a thickness of an upper half thickness of the push plate;

the other push plate arm being a lower arm having a thickness of a lower half thickness of the push plate;

the upper and lower arms being disposed in a same position with respect to the longitudinal direction of said band in a plane including an upper surface of the upper arm and overlapped with each other;

spring means provided between said push plates for urging each of said push plates in an outward direction;

stopping means provided for stopping each of said push plates urged by said spring means at a position where the manipulating projection of each push plate is projected from the housing;

a lock pin secured to an underside of the cover to be engaged with said engaging portions of the push plates; and said stopping means comprises a stopper pin secured to the housing and disposed to be abutted on side walls of notches formed on side portions of the upper and lower arms of the push plates.

5. The buckle according to claim 4 wherein the upper and lower arms of the push plates are disposed on the deflected sides of the push plates, the stopping means comprises a stopper pin secured to the housing and disposed to be abutted on side walls of notches formed on insides of the upper and lower arms of the push plates, the engaging portion of each of said push plates has the engaging hook to be engaged with the lock pin of the cover, the engaging portion has the same thickness as the manipulating projection of the push plate.

6. The buckle according to claim 4 wherein the upper and lower arms of the push plates are disposed on a central portion of each push plate, the stopping means of each push plate includes the engaging hook to be engaged with the lock pin of the cover, the engaging portion having the same thickness as the manipulating projection of a push plate, and the engaging hook being defined by the escapement groove formed on the underside thereof, the cover comprising a pair of connecting lugs formed on opposite sides at a base portion thereof and a lateral plate integrally formed with the lugs.

* * * * *